US005987692A

United States Patent [19]

Sizemore

[11] Patent Number: 5,987,692

[45] **Date of Patent: *Nov. 23, 1999**

[54] PAINT ROLLER WITH MAGNET LOCK

[76] Inventor: James W. Sizemore, 370 NE. 14 St., Homestead, Fla. 33030

[ * ] Notice: This patent is subject to a terminal disclaimer.

[21] Appl. No.: 09/035,805

[22] Filed: Mar. 6, 1998

Related U.S. Application Data

[63] Continuation-in-part of application No. 08/786,647, Jan. 21, 1997, Pat. No. 5,870,795.

[51] Int. Cl.[6] ..... B05C 17/02

[52] U.S. Cl. ..... 15/230.11; 492/13; 492/19

[58] Field of Search ..... 15/230.11; 492/13, 492/19

[56] References Cited

U.S. PATENT DOCUMENTS

| | | | |
|---|---|---|---|
| 3,060,555 | 10/1962 | Kirshenbaum et al. | 15/230.11 X |
| 3,906,581 | 9/1975 | Marino et al. | 15/230.11 |

FOREIGN PATENT DOCUMENTS

| | | | |
|---|---|---|---|
| 1103324 | 5/1955 | France | 15/230.11 |
| 64044 | 5/1955 | France | 15/230.11 |
| 1168672 | 9/1958 | France | 15/230.11 |
| 1558712 | 4/1990 | U.S.S.R. | 15/230.11 |
| 748329 | 4/1956 | United Kingdom | 15/230.11 |
| 1353027 | 5/1974 | United Kingdom | 15/230.11 |

*Primary Examiner*—Mark Spisich
*Attorney, Agent, or Firm*—Robert J. Van Der Wall

[57] ABSTRACT

An apparatus for applying flowable material to a work surface includes a roller frame having a handle portion and an axle portion; a roller cover mounting structure rotatably mounted on the axle portion; a roller cover having an outer cover surface and engagingly fitted over the roller cover mounting structure, for gathering a quantity of the flowable material on the outer cover surface and transferring at least part of the quantity of flowable material to the work surface; and a mounting structure locking mechanism for locking the mounting structure against rotation relative to the roller frame. The locking mechanism preferably locks the mounting structure against rotation releasably, so that the roller cover transfers the flowable material by either rotating or by sliding against the work surface. The locking mechanism is located entirely within the roller to prevent it from being exposed to the flowable material, and operates with a magnet to retain it in either the locked or unlocked mode. The invention also contemplates a method of utilizing the foregoing apparatus by abruptly moving the apparatus to shift the magnet from one operating mode position to another, and vice versa, as well as performing the method remotely using a handle extension.

12 Claims, 2 Drawing Sheets

PAINT ROLLER WITH MAGNET LOCK

CROSS REFERENCE TO OTHER APPLICATIONS

This application is a continuation-in-part to Applicant's earlier application, Ser. No. 08/786,647 filed Jan. 21, 1997, U.S. Pat. No. 5,870,795, was copending therewith and claimed the filing date thereof as to the common subject matter.

BACKGROUND OF THE INVENTION

1. Field of the Invention

The present invention relates generally to the field of paint application devices. More specifically the present invention relates to a roller apparatus for applying paint, stain and other flowable material to a work surface. The roller apparatus includes a roller frame with a handle portion at one end, an axle portion at the other end, and a roller assembly mounted on the axle portion for removably receiving a conventional roller cover. The roller assembly contains within the roller a releasable locking mechanism which frees the roller cover to rotate freely about the axle portion for the conventional rolling application of flowable material, and which alternatively locks the roller cover against rotation about the axle portion for a sliding application of the material. Because the locking mechanism is contained entirely within the roller cover, it is shielded from the flowable material. The handle portion is equipped in the conventional manner with means for connection to handle extensions, such as can be used to paint the ceiling of a room without using a ladder. This is referred to herein as operating the apparatus remotely.

2. Description of the Prior Art

There have long been roller devices for applying paint and other material to work surfaces. A problem with these prior devices has been that a smooth finish is often not attainable because the material transferred by the device rolling element leaves elevated irregularities, such as stipples and bubbles, as the element surface rides over and lifts away from the work surface. Applicant has discovered that a sliding action produces a smooth finish virtually free of such irregularities. Many prior devices are not constructed to perform a sliding application, and those that are have the locking mechanism at least partially external to the roller cover where it is exposed to the flowable material.

An example of such a prior roller device is that of Morgan, et al., U.S. Pat. No. Des. 305,080, filed on Jun. 1, 1987, for what is termed a paint roller frame. Morgan, et al., includes the conventional bent rod roller framework with rotatably mounted, spaced apart cover support disks and an outwardly bowed, longitudinally oriented, wire cage for mounting a roller cover. A problem with Morgan, et al., is that the cover support disks and mounting cage are always free to rotate, so that sliding the roller cover to apply material is awkward or impossible.

Another prior device is that of Jacobs, et al., U.S. Pat. No. 5,182,840, filed on Dec. 19, 1991. Jacobs, et al., discloses an epoxy floor roller tool and method of making the tool for removing air bubbles from an already applied layer of epoxy and polyurethane floor coating materials. A problem with Jacobs, et al., is that no provision is made for sliding application of flowable material. Another problem with Jacobs, et al., is that two steps are required in the material application, namely those of applying the material over the work surface and of subsequently rolling the Jacobs, et al., device over the wet material to remove bubbles. This procedure virtually doubles the work time needed for the project, and similarly increases the cost as well.

Prior art devices that have locking mechanisms that are at least partially external to the roller cover include Marino et al., U.S. Pat. No. 3,906,581, Kirshenbaum et al., U.S. Pat. No. 3,060,555, Lafond, Great Britian Patent Specfication No. 748,329, Noel, French Patent No. 1,103,324, Villette et al., French Patent No. 64,044, Gardoni, French Patent No. 1,168,672, McMillan, Great Britian Patent Specfication No. 1,353,027, and Sukhanov, Soviet Union Inventor's Certificate No. 1558-712A.

It is thus a principal object of the present invention to provide a roller apparatus which is capable of applying flowable material to a work surface in a rolling mode, and which can alternatively apply the material in a sliding mode, with a releasible locking mechanism that is completely internal to the roller to totally shield the locking mechansim from the flowable material.

It is another object of the present invention to provide a roller apparatus which is capable of applying flowable material to a work surface in a rolling mode, and which can alternatively apply the material in a sliding mode, with a releasible locking mechanism that is controlled by a magnet means disposed within the roller cover.

It is further object of the present invention to provide such an apparatus which changes modes of operation simply by abrupt movement of the apparatus, such as by shaking or bumping it, thereby shifting the magnet means from a locked position to an unlocked position, so that no tools or work interruption are necessary. This feature can be of greater significance when the invention is being used with a handle extension, such as when painting overhead without a ladder. The mode of operation of the invention can be shifted with getting close to or touching the invention.

It is still another object of the present invention to provide such an apparatus which has the familiar feel and appearance of a conventional paint roller device, and which accepts the conventional and widely available roller covers.

It is finally an object of the present invention to provide such an apparatus which is durable, reliable, simple in design and inexpensive to manufacture.

SUMMARY OF THE INVENTION

The present invention accomplishes the above-stated objectives, as well as others, as may be determined by a fair reading and interpretation of the entire specification.

An apparatus is provided for applying flowable material to a work surface, including a roller frame having a handle portion and an axle portion; a roller cover mounting structure rotatably mounted on the axle portion; a roller cover having a flowable material retaining surface on the roller cover and engagingly fitted over the roller cover mounting structure, for gathering a quantity of the flowable material on the roller cover and transferring at least part of the quantity of flowable material to the work surface; and a mounting structure locking mechanism disposed entirely within the roller for releasibly locking the mounting structure against rotation relative to the roller frame.

The roller cover mounting structure rotatably mounted on the axle portion for fitting within and supporting the roller cover. The locking structure preferably includes a pin member retaining cylinder containing an aperture. The magnetized pin member retaining cylinder is fixedly mounted to the roller frame. At least one magnetized pin member is slidably retained within the magnetized pin member retaining cylinder aperture in close proximity to the axle portion. The roller cover mounting structure preferably includes at least one magnetized pin member receiving recess, so that the magnetized pin member can slide into the receiving recess to lock the roller cover mounting structure against rotation relative to the roller frame and can slide out of the receiving recess to free the roller cover mounting structure to rotate relative to the roller frame. The axle portion is preferably fabricated from a magnetically attractive material. The magnetized pin member is preferably disposed within the magnetized pin member retaining cylinder aperture in a parallel relationship and in close proximity to the axle portion to create modest friction between the magnetized pin member and the aperture wall of the magnetized pin member retaining cylinder that is closest to the axle portion. At the end of the magnetized pin member retaining cylinder containing the aperture is a small first magnetically attractive member that partially overlaps the aperture opening, preferably a washer around the axle portion. At the closed end of the aperture in the magnetized pin member retaining cylinder is disposed a small second magnetically attractive member, which is preferably a screw or nail. First and second magnetically attractive members tend to retain the magnetized pin member at either end of its slidable movement to either maintain the magnetized pin member in its releasibly locked mode or unlocked mode. This tendency is aided by the modest friction between the magnetized pin member and the wall of the magnetized pin member retaining cylinder aperture. The magnetized pin member preferably has a tapered end to facilitate its entry into the receiving recess of the radial support structure.

The radial support structure preferably includes a tubular side wall having an outer diameter sized to snugly fit within the roller cover and a mounting tube located axially within the tubular side wall. It also includes several radial fins extending between and interconnecting the tubular side wall and the mounting tube and an end wall extending from the mounting tube radially outwardly to the tubular side wall. The radial fins separate several sections thereby defining a plurality of recesses within the tubular side wall.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
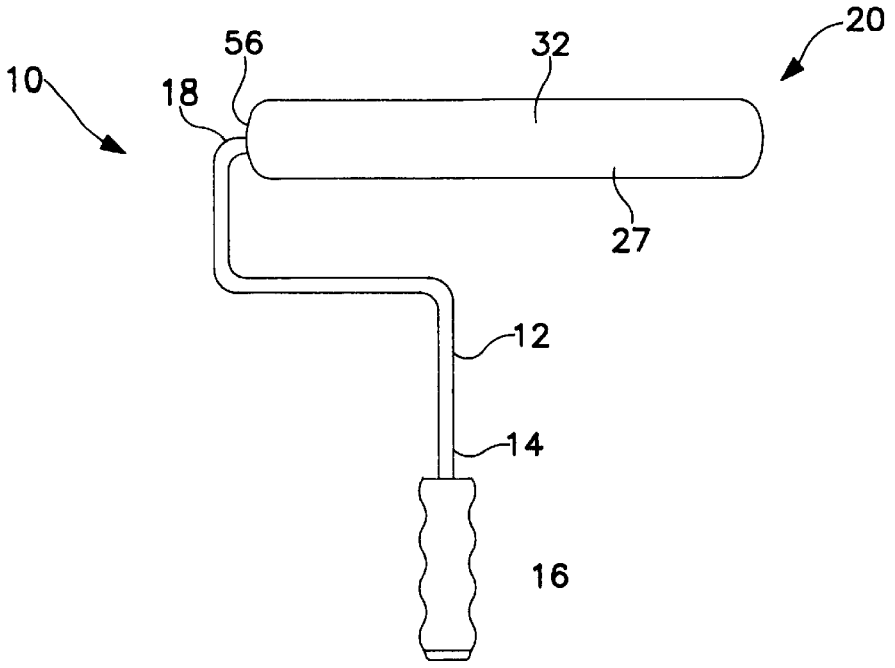
FIG. 1 is a side view of the entire roller apparatus having a roller cover mounted for use.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Figure 2:
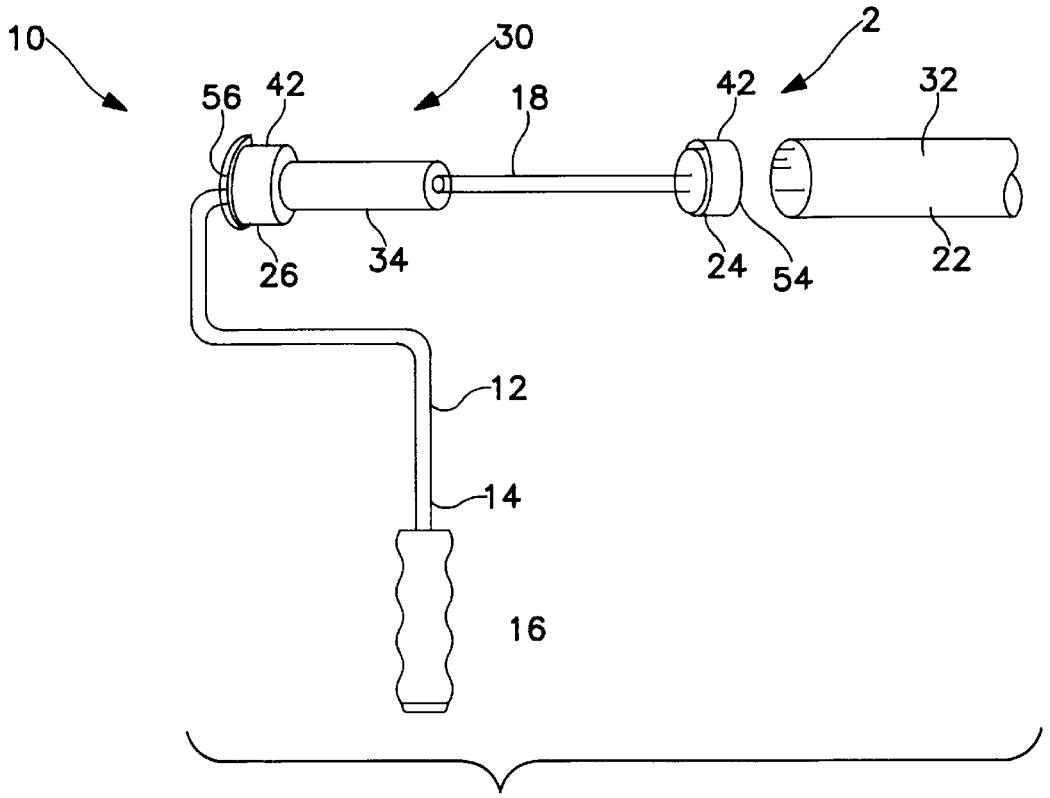
FIG. 2 is a side view as in FIG. 1 with the roller cover removed and positioned to a side of the apparatus ready for installation, and revealing the first and second support disks and the inventive locking mechanism.
Figure 3:
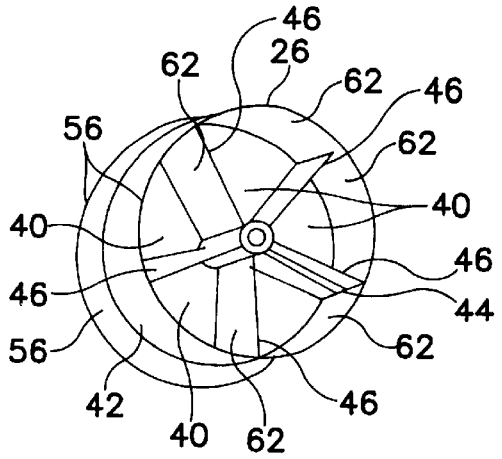
FIG. 3 is an enlarged view of the interior of a conventional roller support disk that interfaces with and is a part of the locking mechanism.

Referring to FIGS. 1–3, a roller apparatus 10 is disclosed for applying paint and other flowable material to work surfaces. Apparatus 10 includes a conventional roller frame 12 with a handle portion 14 and grip 16 at one end and an axle portion 18 at the other end, and a roller assembly 20 mounted on axle portion 18. Roller assembly 20 includes a removable and replaceable roller cover 22 for receiving and transferring the flowable material, a roller cover first support disk 24 rotatably mounted at the axle portion 18 free end, and a roller cover second support disk 26 rotatably mounted at the axle portion 18 connected end. Roller assembly 20 contains a releasable locking mechanism 30.

Locking mechanism 30 permits the roller cover 22 to rotate freely about axle portion 18 for the conventional rolling application of flowable material, and to alternatively lock the roller cover 22 against rotation about axle portion 18 for a sliding application of the material.

Roller cover 22 is a tubular member having a flowable material retaining cover surface 32 of conventional construction. First and second support disks 24 and 26, respectively, are also of conventional construction, each including a tubular side wall 42 having an outer diameter sized to snugly fit within the roller cover 22, a mounting tube 44 axially positioned within tubular side wall 42 and five radial fins 46 extending between and interconnecting tubular side wall 42 and mounting tube 44. See FIGS. 2 and 3. First support disk 24 also includes a first end wall 54 which extends from the mounting tube 44 outwardly to, but not beyond, the tubular side wall 42. Second support disk 26 includes a second end wall 56 which is like first end wall 54 except that it extends radially outward beyond the side wall 42 for stopping and abutting a roller cover 22 fit over first and second support disks 24 and 26. The five radial fins 46 divide the interiors of support disks 24 and 26 and the inner surfaces of end walls 54 and 56 into five equal radial sections 62.

Figure 4:
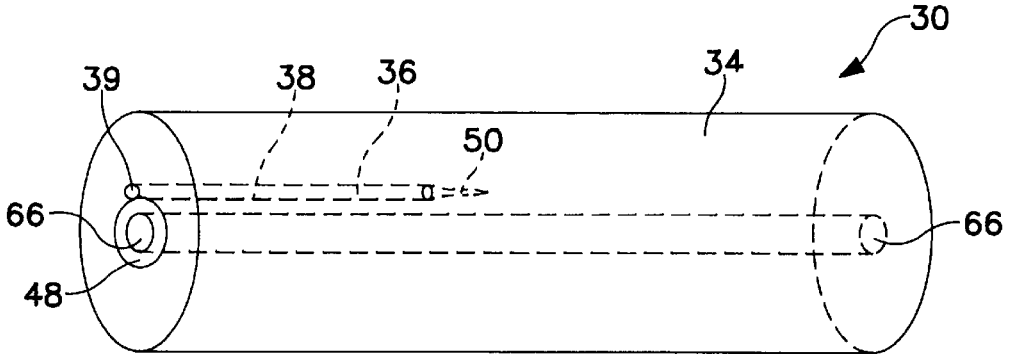
FIG. 4 is a similarly enlarged view of the cylinder that mates up against the roller support disk of FIG. 3 to form the locking mechanism. This cylinder holds the magnetized pin member.
Figure 6:
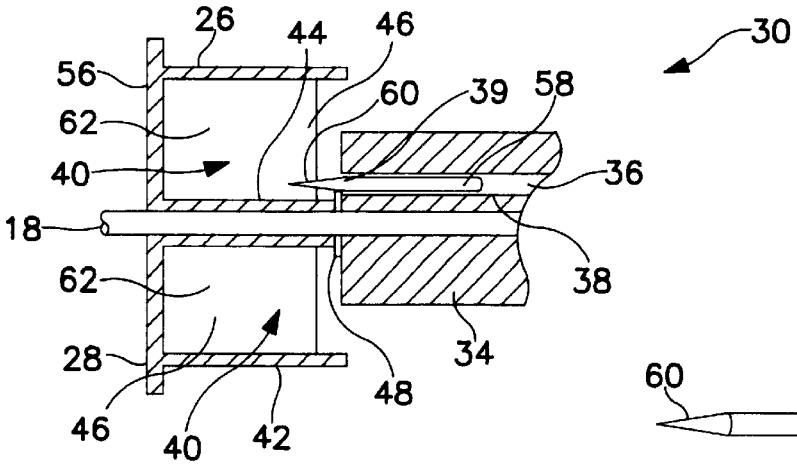
FIG. 6 is a cross section view of the assembled locking mechanism in a locked mode, and showing the magnetized pin member extending out to block rotation of the roller support disk by interfering with the radial fins of said disk.
Figure 5:
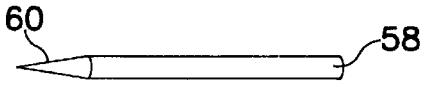
FIG. 5 is a front view of the magnetized pin member showing its tapered end.

FIG. 4 shows magnetized pin member retaining cylinder 34, which is fixedly mounted to the roller frame 12 at the axle portion 18 thereof. At least one magnetized pin member, shown in FIGS. 5 and 6, is slidably retained within the magnetized pin member retaining cylinder aperture 36, shown in phantom. The aperture 36 is disposed in close proximity to the axle portion 18. The roller cover mounting structure 28, of FIG. 3, preferably includes at least one magnetized pin member receiving recess 40, so that the magnetized pin member 58 can slide into the receiving recess 40, as seen in FIG. 6, to lock the roller cover mounting structure 28 against rotation relative to the roller frame 12 and axle portion 18 and can slide out of the receiving recess 40 to free the roller cover mounting structure 28 to rotate relative to the roller frame 12. The axle portion 18 is preferably fabricated from a magnetically attractive material. The magnetized pin member 58 is preferably disposed within the magnetized pin member retaining cylinder aperture 36 in a parallel relationship and in close proximity to the axle portion 18 to create modest friction between the magnetized pin member 58 and the aperture wall 38 of the magnetized pin member retaining cylinder 34 that is closest to the axle portion 18. At the end of the magnetized pin member retaining cylinder 34 containing the aperture 36 is a small first magnetically attractive member 48 that partially overlaps the aperture opening 39, preferably a washer around the axle portion 18. At the closed end of the aperture 36 in the magnetized pin member retaining cylinder 34 is disposed a small second magnetically attractive member 50, which is preferably a screw or nail. First and second magnetically attractive members 48 and 50 tend to retain the magnetized pin member 58 at either end of its slidable movement to either maintain the magnetized pin member 58 in its releasibly locked mode or unlocked mode. This tendency is aided by the modest friction between the magnetized pin member 58 and the wall 38 of the magnetized pin member retaining cylinder aperture 36. The magnetized pin member 58 preferably has a tapered end 60 to facilitate its entry into the receiving recess 40 of the radial support structure 28.

FIG. 6 is a cross section view of the mounting structure locking mechanism 30. It particularly illustrates the penetration of the tapered end 60 of the magnetized pin member 58 into the receiving recess 46 of the roller cover mounting structure 28. It also shows how the first magnetically attractive member 48, preferably a washer, acts both as a stop to the travel of the magnetized pin member 58, and as a retaining means to the magnetized pin member 58 at its maximum point of penetration into the receiving recess 40 past the edges of the radial fins 46 of the roller cover mounting structure 28 (also referred to as the second support disk 26).

Roller cover 22 is supported between support disks 24 and 26 by a wire cage of conventional design which has been omitted from FIGS. 2 and 6 for clarity. The wire cage forms no part of the invention, it being a portion of the structure of a conventional paint roller. Further, magnitized pin member retaining cylinder 34 has a small enough diameter that it fits conveniently between the wire cage and the axle portion. This is significant because the locking mechanism of the present invention requires no modifications whatsoever to a conventional paint roller, and it actually can be retrofitted on one.

Method

In practicing the invention, the following method may be used. For apparatus 10 operation in the rotating roller cover mode, the magnetized pin members 58 is positioned against and retained by second magnetically attractive member 50, with the assistance of the modest friction established at aperture wall 38 by the attraction of magnetized pin member 58 to the magnetically attractive nature of axle portion 18 in close proximity. To convert apparatus 10 operation to the fixed roller cover mode for sliding application of material, the user simply lowers the axle portion 18 proximal to the mounting structure locking mechanism relative to the other end and abruptly moves apparatus 10, preferably an end of axle portion 18, such as by shaking it or bumping it against the palm of a hand or another object.

If the apparatus is being used with a handle extension (not shown because a handle extension is conventional), abrupt motion can still be accomplished without bringing the apparatus down from a remote location. This represents a significant advantage because all known prior art requires the laborious extra steps of bringing it down, manually switching modes, and putting it back up.

In any event, the abrupt movement jars magnetized pin member 58 loose from second magnetically attractive member 50 and permits it to slide within aperture 36 so that its tapered end 60 penetrates into the magnetized pin member receiving recess 40 between radial fins 46 of roller cover mounting structure 28, also referred to as second support disk 26. It is then releasably retained by first magnetically attractive member 48 with the assistance of the modest friction established at aperture wall 38 by the attraction of magnetized pin member 58 to the magnetically attractive nature of axle portion 18 in close proximity. To return apparatus 10 to the rotating roller cover mode, the user simply lowers the axle portion 18 distal to the mounting structure locking mechanism relative to the other end and abruptly moves apparatus 10, preferably an end of axle portion 18, such as by shaking it or bumping it against the palm of a hand or another object. The same advantage of this method when the apparatus is in remote usage of course applies. The abrupt motion jars magnetized pin member 58 loose from first magnetically attractive member 48 and permits it to slide within aperture 36 so that its tapered end 60 retracts completely into the magnetized pin member retaining cylinder aperture 36 of retaining cylinder 34. It is then releasably retained by second magnetically attractive member 50 with the assistance of the modest friction established at aperture wall 38 by the attraction of magnetized pin member 58 to the magnetically attractive nature of axle portion 18 in close proximity. Since the magnetized pin member 58 and second support disk 26 are thereby disconnected, the second support disk 26 and roller cover 22 are again freed to rotate relative to axle portion 18 of roller frame 12 for rolling application of flowable material.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An improved apparatus for applying flowable material to a work surface including a roller frame having a handle portion and an axle portion, a roller cover mounting structure rotatably mounted on said axle portion, a roller cover having an outer cover surface and engagingly fitted over said roller cover mounting structure, for gathering a quantity of said flowable material on said outer cover surface and transferring at least part of said quantity of flowable material to said work surface, wherein the improvement comprises:

a mounting structure locking mechanism for releasibly locking said mounting structure against rotation relative to said roller frame, said locking mechanism being disposed entirely within the roller cover and roller cover mounting structure to shield said locking mechanism from the flowable material.

2. The improved apparatus of claim 1, wherein said locking mechanism uses a magnet for releasible retention of the apparatus in a locked and an unlocked mode.

3. The improved apparatus of claim 1, said locking mechanism comprising:

a magnetized pin member retainer fixedly mounted to said roller frame;

a magnetized pin member slidably retained within said magnetized pin member retainer; and a magnetized pin member receiving recess in said roller cover mounting structure, such that said magnetized pin member slides into said receiving recess to lock said roller cover mounting structure against rotation relative to said roller frame and slides out of said receiving recess to free said roller cover mounting structure to rotate relative to said roller frame.

4. The improved apparatus of claim 3, additionally comprising:

a first magnetically attractive member for releasably retaining said magnetized pin member in a position within said recess; and a second magnetically attractive member for releasably retaining said magnetized pin member outside of said recess.

5. The improved apparatus of claim 3, additionally comprising:

an aperture disposed within said magnetized pin member retainer proximal and in parallel relationship to the axle portion, said axle portion being made of a magnetically attractive material whereby the magnetized pin member that is slidably retained within said aperture of said magnetized pin member retainer is releasibly retained by modest friction between the magnetized pin member and a wall of said aperture proximal said axle portion by reason of magnetic attraction between the magnetized pin member and the axle portion.

6. An improved apparatus for applying flowable material to a work surface including a roller frame having a handle portion and an axle portion, a roller cover mounting structure rotatably mounted on said axle portion, a roller cover having an outer cover surface and engagingly fitted over said roller cover mounting structure, for gathering a quantity of said flowable material on said outer cover surface and transferring at least part of said quantity of flowable material to said work surface, wherein the improvement comprises:

a mounting structure locking mechanism for locking said mounting structure against rotation relative to said roller frame, said locking mechanism using a magnet for releasible retention of the apparatus in a locked mode and in an unlocked mode.

7. The improved apparatus of claim 6 in which said locking mechanism is disposed entirely within the roller cover and roller cover mounting structure to shield said locking mechanism from the flowable material.

8. The improved apparatus of claim 6 in which the locking mechanism comprises:

a magnetized pin member retainer fixedly attached to the axle portion;

a magnetized pin member slidingly retained within said retainer; and a magnetized pin receiving recess in said roller cover mounting structure, such that said magnetized pin member slides into said receiving recess to lock said roller cover mounting structure against rotation relative to said roller frame and slides out of said receiving recess to free said roller cover mounting structure to rotate relative to said roller frame.

9. The improved apparatus of claim 8, additionally comprising:

a first magnetically attractive member for releasably retaining said magnetized pin member in a position within said recess; and a second magnetically attractive member for releasably retaining said magnetized pin member outside of said recess.

10. The improved apparatus of claim 8, additionally comprising:

an aperture disposed within said magnetized pin member retainer proximal and in parallel relationship to the axle portion, said axle portion being made of a magnetically attractive material whereby the magnetized pin member that is slidably retained within said aperture of said magnetized pin member retainer is releasibly retained by modest friction between the magnetized pin member and a wall of said aperture proximal said axle portion by reason of magnetic attraction between the magnetized pin member and the axle portion.

11. A method of releasibly locking and unlocking an improved apparatus for applying flowable material to a work surface including a roller frame having a handle portion and an axle portion, a roller cover mounting structure rotatably mounted on said axle portion, a roller cover having an outer cover surface and engagingly fitted over said roller cover mounting structure, for gathering a quantity of said flowable material on said outer cover surface and transferring at least part of said quantity of flowable material to said work surface, and also having a mounting structure locking mechanism at a first end of the axle portion for releasibly locking said mounting structure against rotation relative to said roller frame, said locking mechanism including a magnetized pin member retainer fixedly mounted to said roller frame, a magnetized pin member slidably retained within said magnetized pin member retainer, and a magnetized pin member receiving recess in said roller cover mounting structure, such that said magnetized pin member slides into said receiving recess to lock said roller cover mounting structure against rotation relative to said roller frame and slides out of said receiving recess to free said roller cover mounting structure to rotate relative to said roller frame, comprising the steps of:

lowering the first end of the axle portion relative to a second end of the axle portion;

abruptly moving the apparatus near the axle portion to jar the magnetized pin member loose permitting it to slide so that it penetrates into the receiving recess of the roller cover mounting structure thereby releasibly locking the apparatus for sliding application of flowable material;

lowering the second end of the axle portion relative to the first end; and abruptly moving the apparatus near the axle portion to jar the magnetized pin member loose permitting it to slide and retract completely within said magnetized pin member retainer so that the roller cover mounting structure is again free to rotate relative to the axle portion of roller frame for rolling application of flowable material.

12. The method of claim 11 which when using a handle extension further comprises abruptly moving the apparatus remotely using said handle extension.

* * * * *